US010685631B2

(12) United States Patent
Ichiki et al.

(10) Patent No.: US 10,685,631 B2
(45) Date of Patent: Jun. 16, 2020

(54) KEYBOARD APPARATUS

(71) Applicant: YAMAHA CORPORATION, Hamamatsu-shi (JP)

(72) Inventors: Shunsuke Ichiki, Hamamatsu (JP); Ichiro Osuga, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 10 days.

(21) Appl. No.: 16/139,776

(22) Filed: Sep. 24, 2018

(65) Prior Publication Data

US 2019/0027121 A1 Jan. 24, 2019

Related U.S. Application Data

(63) Continuation of application No. PCT/JP2017/011676, filed on Mar. 23, 2017.

(30) Foreign Application Priority Data

Mar. 25, 2016 (JP) ..... 2016-061639

(51) Int. Cl.
*G10D 3/12* (2020.01)
*G10C 3/12* (2006.01)
*G10H 1/34* (2006.01)

(52) U.S. Cl.
CPC ..... *G10C 3/12* (2013.01); *G10H 1/34* (2013.01); *G10H 1/346* (2013.01); *G10H 2220/285* (2013.01)

(58) Field of Classification Search
CPC ..... G10C 3/12; G10H 1/346; G10H 1/34
See application file for complete search history.

(56) References Cited

U.S. PATENT DOCUMENTS 4,129,057 A * 12/1978 Hoshi ..... G10C 3/12 84/434
4,488,472 A * 12/1984 Kumano ..... G10H 1/32 84/434
4,892,024 A * 1/1990 Watanabe ..... G10H 1/344 84/423 R
4,993,305 A * 2/1991 Franz ..... G10H 1/346 84/439

(Continued)

FOREIGN PATENT DOCUMENTS

JP H0349595 U 5/1991
JP H10116066 A 5/1998

(Continued)

OTHER PUBLICATIONS

International Search Report issued in International Application No. PCT/JP2017/011676 dated Jun. 6, 2017. English translation provided.

(Continued)

*Primary Examiner* — Robert W Horn
(74) *Attorney, Agent, or Firm* — Rossi, Kimms & McDowell LLP

(57) ABSTRACT

According to an embodiment of the present invention, a keyboard apparatus includes a key; and a connecting member connecting the key to a frame and including a rod-like flexible member arranged between the frame and the key, the key being turned to the frame by bending of the rod-like flexible member.

9 Claims, 12 Drawing Sheets

(56) References Cited

U.S. PATENT DOCUMENTS

| | | | | | |
|---|---|---|---|---|---|
| 5,259,287 | A * | 11/1993 | Sato | G10C 3/12 | 84/432 |
| 5,574,241 | A * | 11/1996 | Kumano | G10C 3/12 | 84/433 |
| 5,959,228 | A * | 9/1999 | Yamaguchi | G10H 1/344 | 84/433 |
| 6,133,517 | A * | 10/2000 | Masubuchi | G10C 3/12 | 84/423 R |
| 7,427,723 | B2 | 9/2008 | Watanabe | | |
| 7,476,795 | B2 * | 1/2009 | Toyama | G10C 3/12 | 84/423 R |
| 7,544,876 | B2 * | 6/2009 | Toyama | G10C 3/12 | 84/423 R |
| 7,586,030 | B2 * | 9/2009 | Nishida | G10C 3/12 | 84/423 R |
| 8,119,895 | B2 * | 2/2012 | Kitajima | G10H 1/346 | 84/423 R |
| 8,440,896 | B2 * | 5/2013 | Hoshino | G10C 3/12 | 84/423 R |
| 8,952,232 | B2 * | 2/2015 | Parsons | G10C 3/12 | 84/429 |
| 9,082,372 | B2 * | 7/2015 | Suzuki | G10C 3/12 | |
| 9,576,559 | B1 * | 2/2017 | Morong | G10C 3/12 | |
| 10,311,847 | B2 * | 6/2019 | Ichiki | G10H 1/346 | |
| 2009/0007757 | A1 | 1/2009 | Nishida | | |
| 2015/0294650 | A1 | 10/2015 | Nishida | | |
| 2019/0012996 | A1 * | 1/2019 | Ichiki | G10B 3/12 | |
| 2019/0027121 | A1 * | 1/2019 | Ichiki | G10C 3/12 | |
| 2019/0035371 | A1 * | 1/2019 | Ichiki | G10B 3/12 | |
| 2019/0251939 | A1 * | 8/2019 | Ichiki | G10H 1/346 | |

FOREIGN PATENT DOCUMENTS

| | | | |
|---|---|---|---|
| JP | 2000066660 | A | 3/2000 |
| JP | 2001125573 | A | 5/2001 |
| JP | 2007328180 | A | 12/2007 |
| JP | 2008191650 | A | 8/2008 |
| JP | 2009014817 | A | 1/2009 |
| JP | 2011017904 | A | 1/2011 |
| JP | 2015203762 | A | 11/2015 |

OTHER PUBLICATIONS

Written Opinion issued in International Application No. PCT/JP2017/011676 dated Jun. 6, 2017.

English translation of Written Opinion issued in Intl. Appln. No. PCT/JP2017/011676 dated Jun. 6, 2017. Previously cited in IDS filed Sep. 24, 2018.

Office Action issued in Japanese Appln. No. 2018-507403 dated Aug. 20, 2019. English translation provided.

* cited by examiner

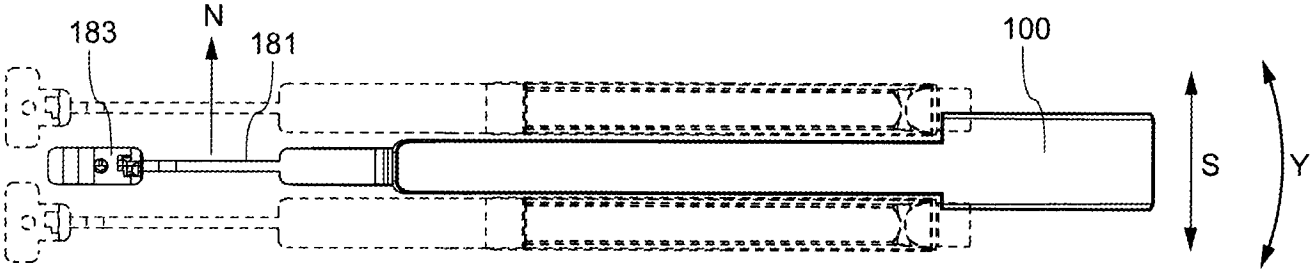
FIG.7A
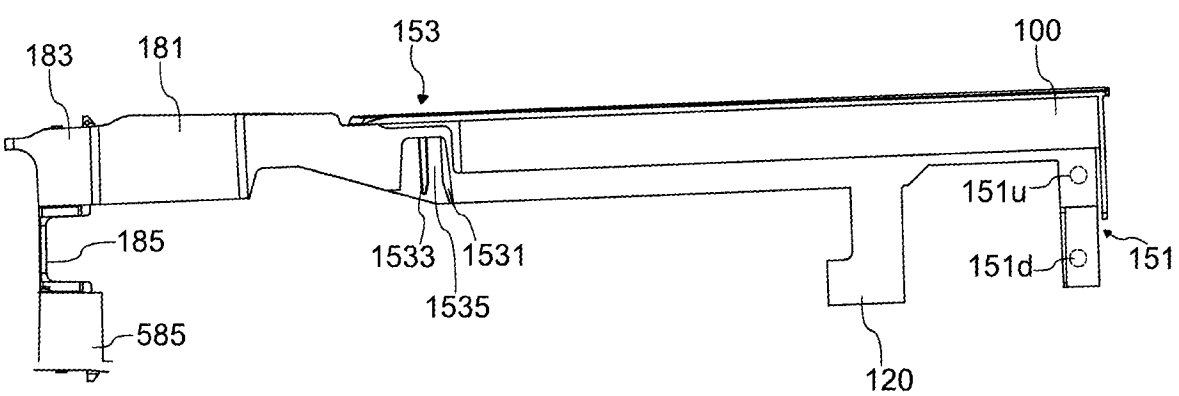
FIG.7B
FIG.7D
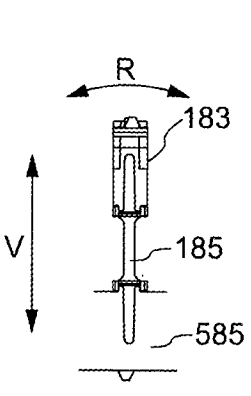
FIG.7C

KEYBOARD APPARATUS

CROSS REFERENCE TO RELATED APPLICATIONS

This application is a U.S. continuation application filed under 35 U.S.C. § 111(a), of International Application No. PCT/JP2017/011676, filed on Mar. 23, 2017, which claims priority to Japanese Patent Application No. 2016-061639, filed on Mar. 25, 2016, the disclosures of which are incorporated by reference.

FIELD

The present invention relates to a keyboard apparatus.

BACKGROUND

As one example of a structure of turning a key in a keyboard apparatus, there is a structure where a thin plate having flexibility is arranged horizontally (e.g., PTL 1: Japanese Patent Application Laid-Open No. 2008-191650). By deforming this thin plate, the key can be turned in upward and downward directions. In PTL 1, a structure that by further using another thin plate arranged vertically concurrently and serially connecting the same to the thin plate arranged horizontally, movement in a direction in which keys are arrayed can be allowed is also disclosed.

SUMMARY

According to an embodiment of the present invention, a keyboard apparatus including a key; and a connecting member connecting the key to a frame and including a rod-like flexible member arranged between the frame and the key, the key being turned to the frame by bending of the rod-like flexible member is provided.

BRIEF DESCRIPTION OF THE DRAWINGS

FIG. 7A is a view describing a detailed structure of a white key according to the first embodiment and a view of when the white key is seen from an upper surface.

FIG. 7B is a view describing the detailed structure of the white key according to the first embodiment and a view of when the white key is seen from a side surface (left side).

FIG. 7C is a view describing the detailed structure of the white key according to the first embodiment and a view of when the connecting portion is seen from a far side.

FIG. 7D is a view describing the detailed structure of the white key according to the first embodiment and a view of when the white key is seen from a near side.

DESCRIPTION OF EMBODIMENTS

Figure 1:
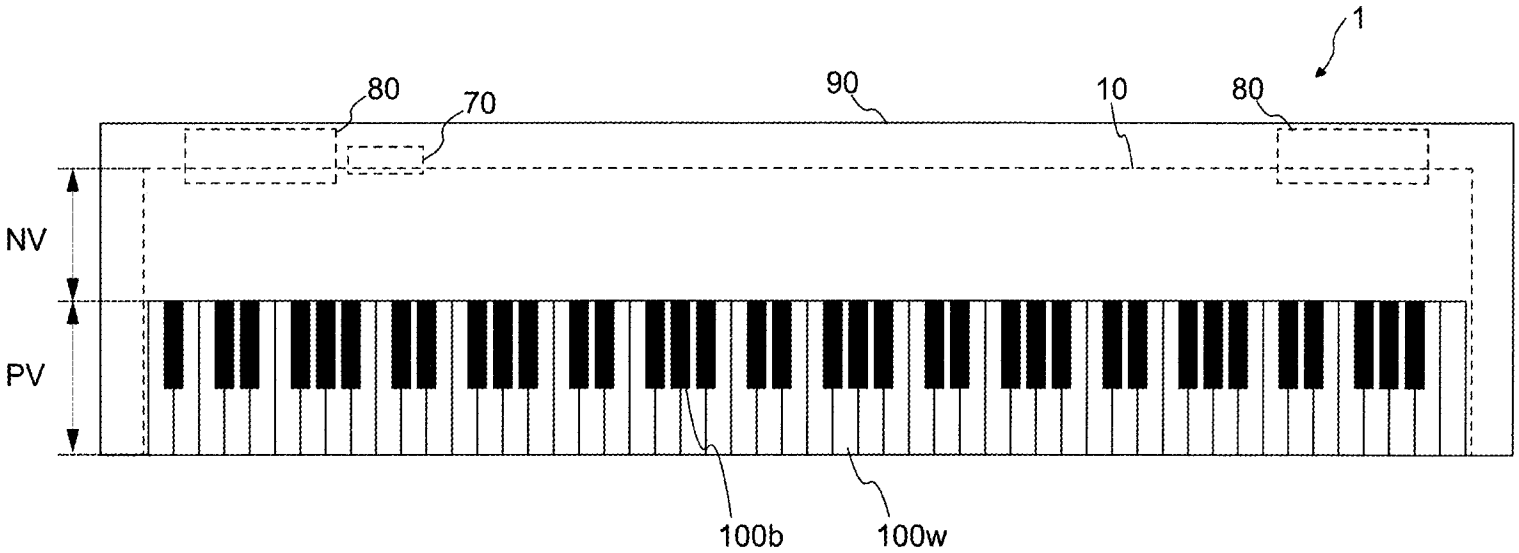
FIG. 1 is a view showing a configuration of a keyboard apparatus according to a first embodiment.

A keyboard apparatus according to one embodiment of the present invention will be hereinafter described in detail with reference to the drawings. The embodiment described below is an example of the embodiment of the present invention, and the present invention should not be interpreted as being limited to such embodiment. In the figures referenced in the present embodiment, the same reference numeral or similar reference numeral (reference numeral simply added with A, B etc. after the number) is denoted on the same portion or the portion having similar function, and redundant description is sometimes omitted. Furthermore, a dimensional ratio (ratio between each configuration, ratio in longitudinal, lateral and height direction, etc.) of the figure may be different from the actual ratio, or one part of the configuration may be omitted from the figure for the sake of convenience of explanation.

A case where a key is moved in a direction in which keys are arrayed from its original position occurs due to not only a playing operation but also manufacturing error of the key or temporary change. Even in such a situation, according to the technique disclosed in PTL 1, movement of the key in the direction in which the keys are arrayed can be allowed by flexibility of a thin plate. However, since a thin plate (horizontal) turning the key and a thin plate (vertical) allowing movement of the key in the direction in which the keys are arrayed must be directly connected to each other, there is a region where the respective thin plates are arranged. When the region is small, the thin plates must be made small, resulting in enlargement of a load occurring when the thin plates are bent. When a large thin plate is used in order to reduce the load, the keyboard apparatus must be made large.

One of objects of the present invention is to provide a structure where while an influence on a size of a keyboard apparatus is suppressed, movement or deformation of a key in various directions is allowed.

First Embodiment

[Configuration of Keyboard Apparatus]

FIG. 1 is a view showing a configuration of a keyboard apparatus according to a first embodiment. In this example, a keyboard apparatus 1 is an electronic keyboard musical instrument that outputs a sound in response to the pushing of a key by a user (player) such as an electronic piano. The keyboard apparatus 1 may be a keyboard type controller that outputs control data (e.g., MIDI) for controlling an external sound source device in response to the pushing of the key. In this case, the keyboard apparatus 1 may not include the sound source device.

The keyboard apparatus 1 includes a keyboard assembly 10. The keyboard assembly 10 includes a white key 100*w* and a black key 100*b*. A plurality of white keys 100*w* and a plurality of black keys 100*b* are arrayed side by side. The number of keys 100 is N, and is 88 in this example, but the number of keys is not limited thereto. A direction in which the keys 100 are arrayed is called a scale direction. When a description can be made without particularly distinguishing the white key 100*w* and the black key 100*b*, the white key 100*w* and the black key 100*b* are sometimes referred to as the key 100. In the following description, the configuration with "w" denoted at the end of the reference numeral is the configuration corresponding to the white key. The configuration with "b" denoted at the end of the reference numeral is the configuration corresponding to the black key.

One part of the keyboard assembly 10 exists inside a housing 90. When the keyboard apparatus 1 is seen from above, a portion of the keyboard assembly 10 covered by the housing 90 is referred to as a non-appearing portion NV, and a portion exposed from the housing 90 and visible from the user is referred to as an appearing portion PV. In other words, the appearing portion PV indicates a region constituting one part of the key 100 that can be played and operated by the user. Hereinafter, a portion of the key 100 exposed by the appearing portion PV is sometimes referred to as a key main body portion.

A sound source device 70 and a speaker 80 are arranged inside the housing 90. The sound source device 70 generates a sound waveform signal accompanying the pushing of the key 100. The speaker 80 outputs the sound waveform signal generated by the sound source device 70 to an external space. The keyboard apparatus 1 may include a slider for controlling the volume, a switch for switching the tone, a display for displaying various information, and the like.

In the description of the present specification, directions such as up, down, left, right, near, far, and the like are directions of when the keyboard apparatus 1 is seen from the player when playing. For example, the non-appearing portion NV can be expressed as being located on the far side from the appearing portion PV. The direction may be indicated with the key 100 as the reference such as a key front end side (key front side) and key back end side (key back side). In this case, the key front end side indicates the near side seen from the player with respect to the key 100. The key back end side indicates the far side seen from the player with respect to the key 100. According to the definition described above, in the black key 100*b*, the front end to the back end of the key main body portion of the black key 100*b* can be expressed as being a portion projecting out toward the upper side from the white key 100*w*.

Figure 2:
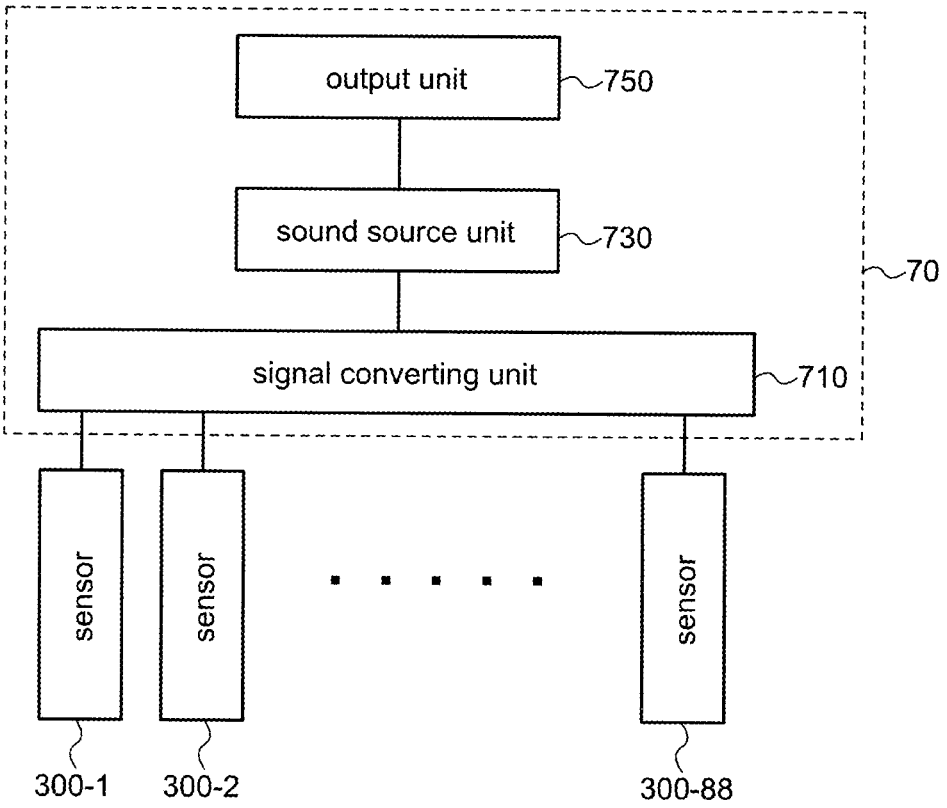
FIG. 2 is a block diagram showing a configuration of a sound source device according to the first embodiment.

FIG. 2 is a block diagram showing a configuration of the sound source device in the first embodiment. The sound source device 70 includes a signal converting unit 710, a sound source unit 730, and an output unit 750. A sensor 300 is arranged in correspondence with each key 100 to detect the operation of the key, and output a signal corresponding to the detected content. In this example, the sensor 300 outputs a signal according to a key-pushing amount of three stages. A key-pushing speed can be detected according to an interval of such signals.

The signal converting unit 710 acquires an output signal of the sensor 300 (sensors 300-1, 300-2, . . . , 300-88 corresponding to 88 keys 100), and generates an operation signal corresponding to an operation state in each key 100, and outputs the operation signal. In this example, the operation signal is a signal of MIDI format. The signal converting unit 710 thus outputs a note-on according to the key-pushing operation. A key number indicating which one of the 88 keys 100 is operated, and a velocity corresponding to the key-pushing speed is output in correspondence with the note-on. The signal converting unit 710 corresponds and outputs the key number and a note-off according to a key releasing operation. A signal corresponding to other operations of a pedal, and the like may be input to the signal converting unit 710, and reflected on the operation signal.

The sound source unit 730 generates the sound waveform signal based on the operation signal output from the signal converting unit 710. The output unit 750 outputs the sound waveform signal generated by the sound source unit 730. The sound waveform signal is, for example, output to the speaker 80, a sound waveform signal output terminal, and the like.

[Configuration of Keyboard Assembly]

Figure 3:
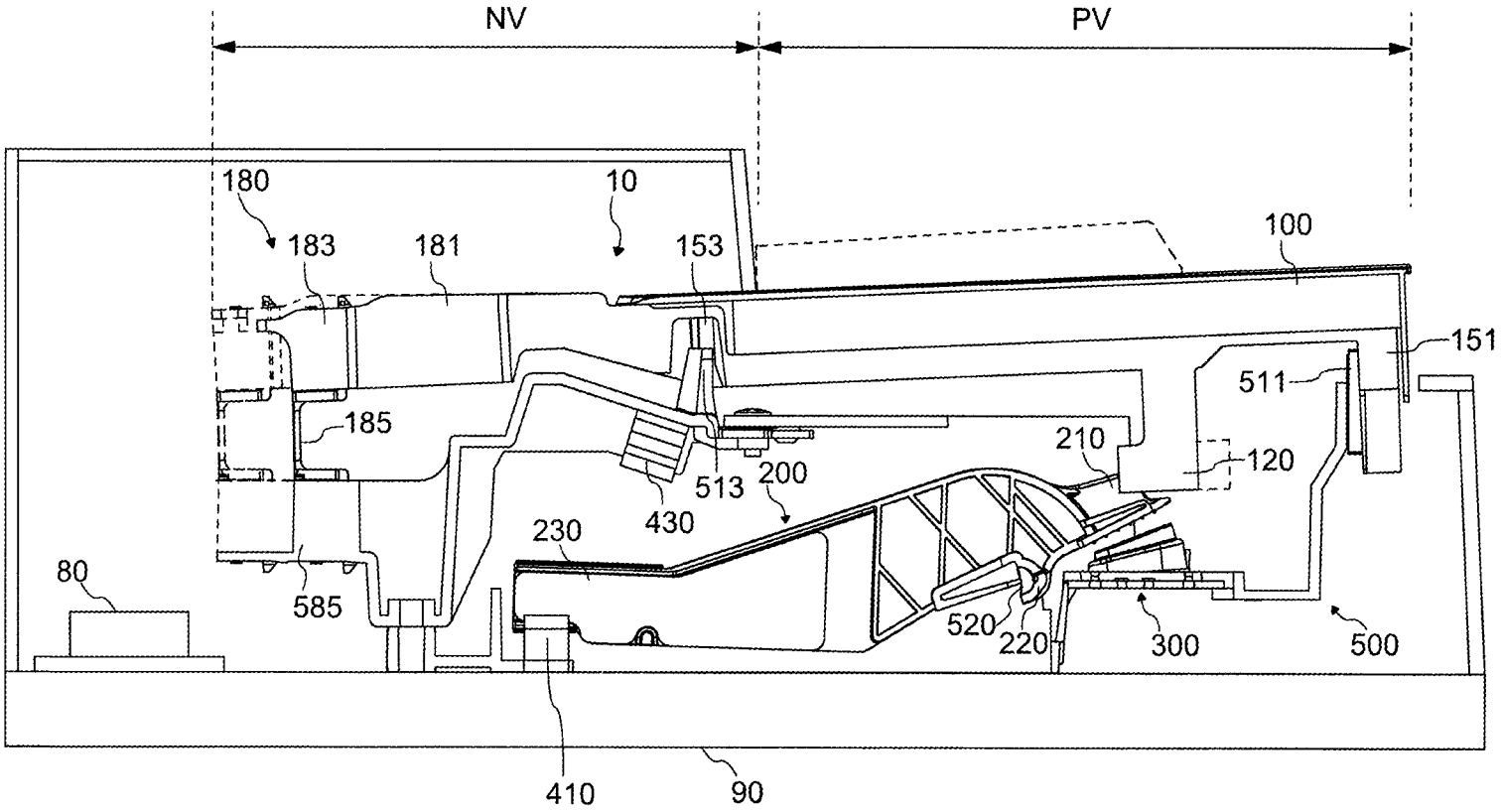
FIG. 3 is an explanatory view of when a configuration inside a housing according to the first embodiment is seen from a side surface.

FIG. 3 is an explanatory view of when the configuration inside the housing according to the first embodiment is seen from a side surface. As shown in FIG. 3, the keyboard assembly 10 and the speaker 80 are arranged inside the housing 90. The speaker 80 is arranged on the far side of the keyboard assembly 10. The speaker 80 is arranged to output the sound corresponding to the pushing of the key toward the upper side and the lower side of the housing 90. The sound output toward the lower side advances toward the outside from the lower surface side of the housing 90. The sound output toward the upper side passes from the inside of the housing 90 through a space inside the keyboard assembly 10, and advances toward the outside from the gap between the adjacent keys 100 in the appearing portion PV or the gap between the key 100 and the housing 90.

The configuration of the keyboard assembly 10 will be described using FIG. 3. In addition to the key 100 described above, the keyboard assembly 10 also includes a connecting portion 180, a hammer assembly 200, and a frame 500. The keyboard assembly 10 is a structural body made of resin in which the majority of the configuration is manufactured by injection molding, and the like. The frame 500 is fixed to the housing 90. The connecting portion 180 turnably connects the key 100 to the frame 500. The connecting portion 180 includes a plate-like flexible member 181, a key side supporting portion 183, and a rod-like flexible member 185. The connecting portion 180 may include a member that moves integrally with the key 100, or may further include a member that moves integrally with the frame 500. The plate-like flexible member 181 is extended from the back end of the key 100. The key side supporting portion 183 is extended from the back end of the plate-like flexible member 181. The rod-like flexible member 185 is supported by the key side supporting portion 183 and a frame side supporting portion 585 of the frame 500. In other words, the rod-like flexible member 185 is arranged between the key 100 and the frame 500. The key 100 can be turned with respect to the frame 500 when the rod-like flexible member 185 is bent. The rod-like flexible member 185 is configured to be detachable from the key side supporting portion 183 and the frame side supporting portion 585. The rod-like flexible member 185 may be integral with at least one of the key side supporting portion 183 or the frame side supporting portion 585, or may be adhered thereto so as not be detachable.

The key 100 includes a front end key guide 151 and a side key guide 153. The front end key guide 151 is slidably brought into contact with a front end frame guide 511 of the frame 500 while covering the front end frame guide 511. The front end key guide 151 is brought into contact with the front end frame guide 511 from both sides in the scale direction, the upper part and the lower part. In the front end key guide 151, the upper part corresponds to an upper key guide 151*u*, and the lower part corresponds to a lower key guide 151*d* (see FIGS. 7A to 7D). The side key guide 153 is slidably brought into contact with a side frame guide 513 from both sides in the scale direction. In this example, the side key guide 153 is arranged in a region corresponding to the non-appearing portion NV of the side surface of the key 100, and exists on the key front end side from the connecting portion 180 (plate-like flexible member 181), but may be arranged in a region corresponding to the appearing portion PV.

The hammer assembly 200 is turnably attached to the frame 500. A shaft supporting portion 220 of the hammer assembly 200 and a shaft 520 of the frame 500 are slidably brought into contact at at least three points. A front end 210 of the hammer assembly 200 is brought into contact with a hammer supporting portion 120 in an internal space of the hammer supporting portion 120 in a manner slidable in essentially a front and back direction. The slidably moving portion, that is, the portion where the front end 210 and the hammer supporting portion 120 are brought into contact is located on the lower side of the key 100 in the appearing portion PV (front side from the back end of the key main body portion).

The hammer assembly 200 includes a weight portion 230 made of metal at a far side from the shaft. At a normal time (when key is not pushed), the weight portion 230 is mounted on a lower stopper 410, and the front end 210 of the hammer assembly 200 is pushing back the key 100. When the key is pushed, the weight portion 230 is moved upward thus hitting an upper stopper 430. The hammer assembly 200 applies a load to the pushing of the key with the weight portion 230. The lower stopper 410 and the upper stopper 430 are formed with a buffer material and the like (non-woven cloth, elastic body, etc.).

The sensor 300 is attached to the frame 500 on the lower side of the hammer supporting portion 120 and the front end 210. The front end 210 deforms the sensor 300 with the lower surface side thereof according to the pushing of the key, and the sensor 300 outputs a detection signal. As described above, the sensor 300 is arranged in correspondence with each key 100.

Figure 4:
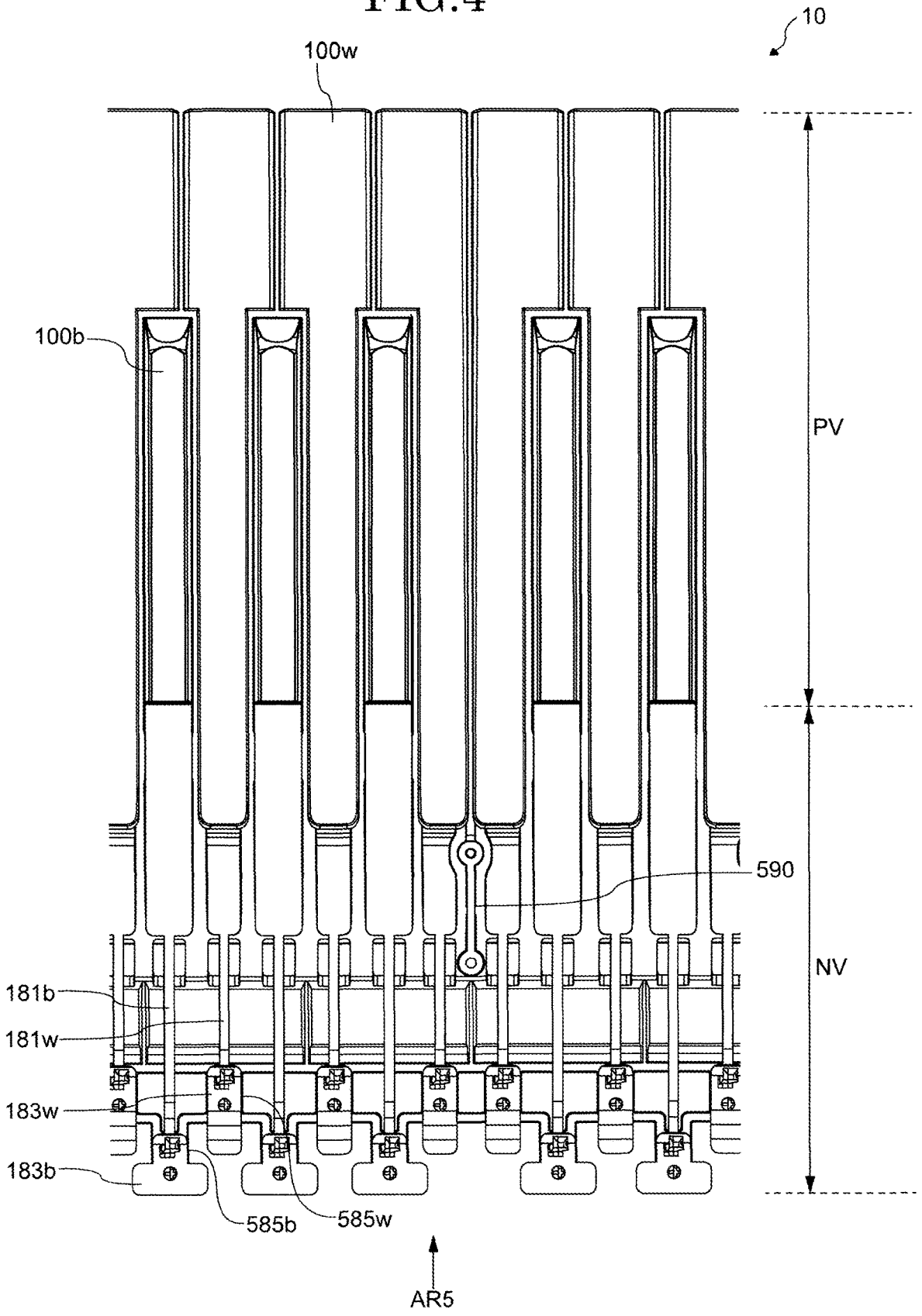
FIG. 4 is an explanatory view of when a keyboard assembly according to the first embodiment is seen from an upper surface.
Figure 5:
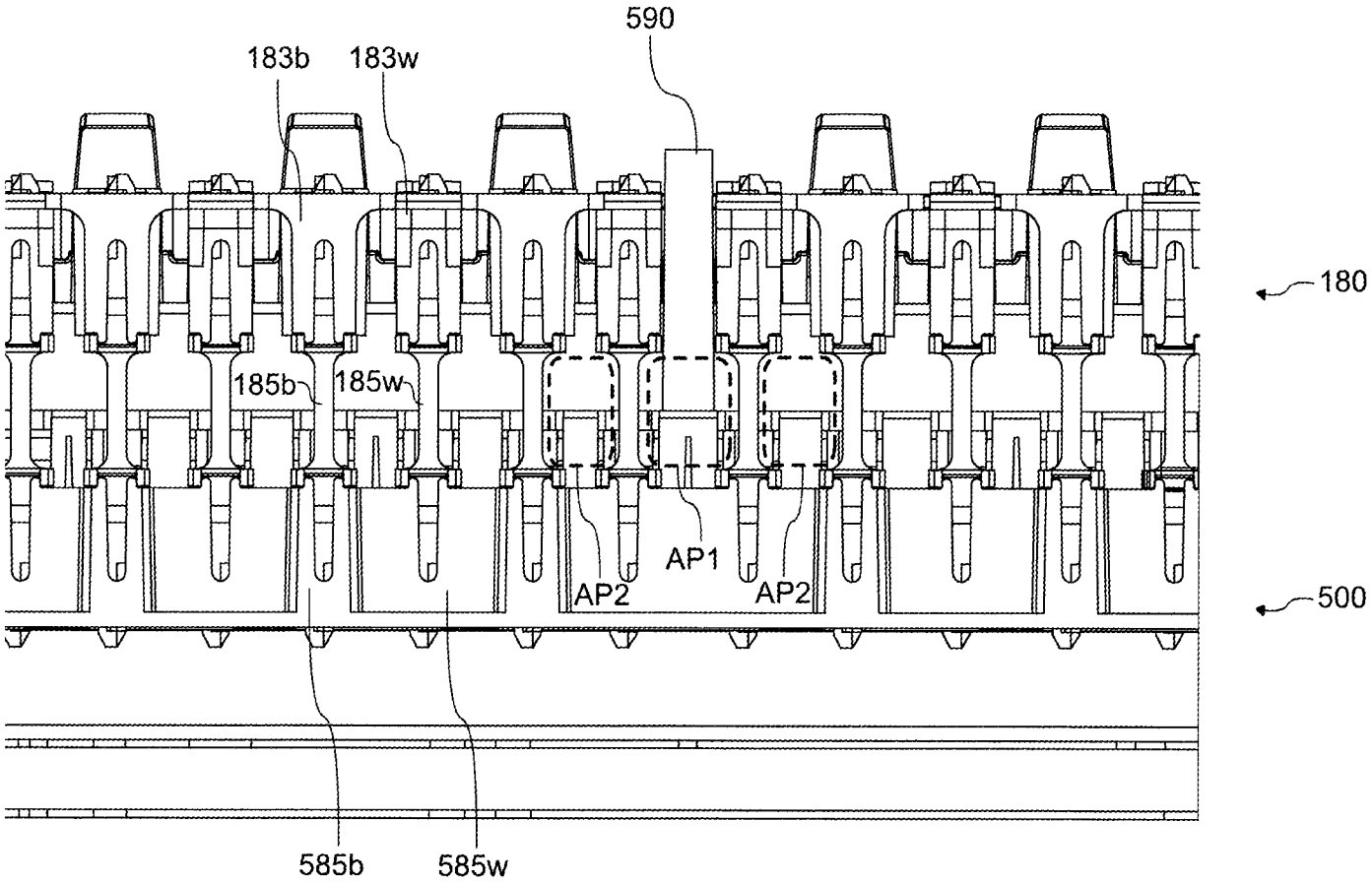
FIG. 5 is an explanatory view of when a frame according to the first embodiment is seen from a far side.
Figure 6:
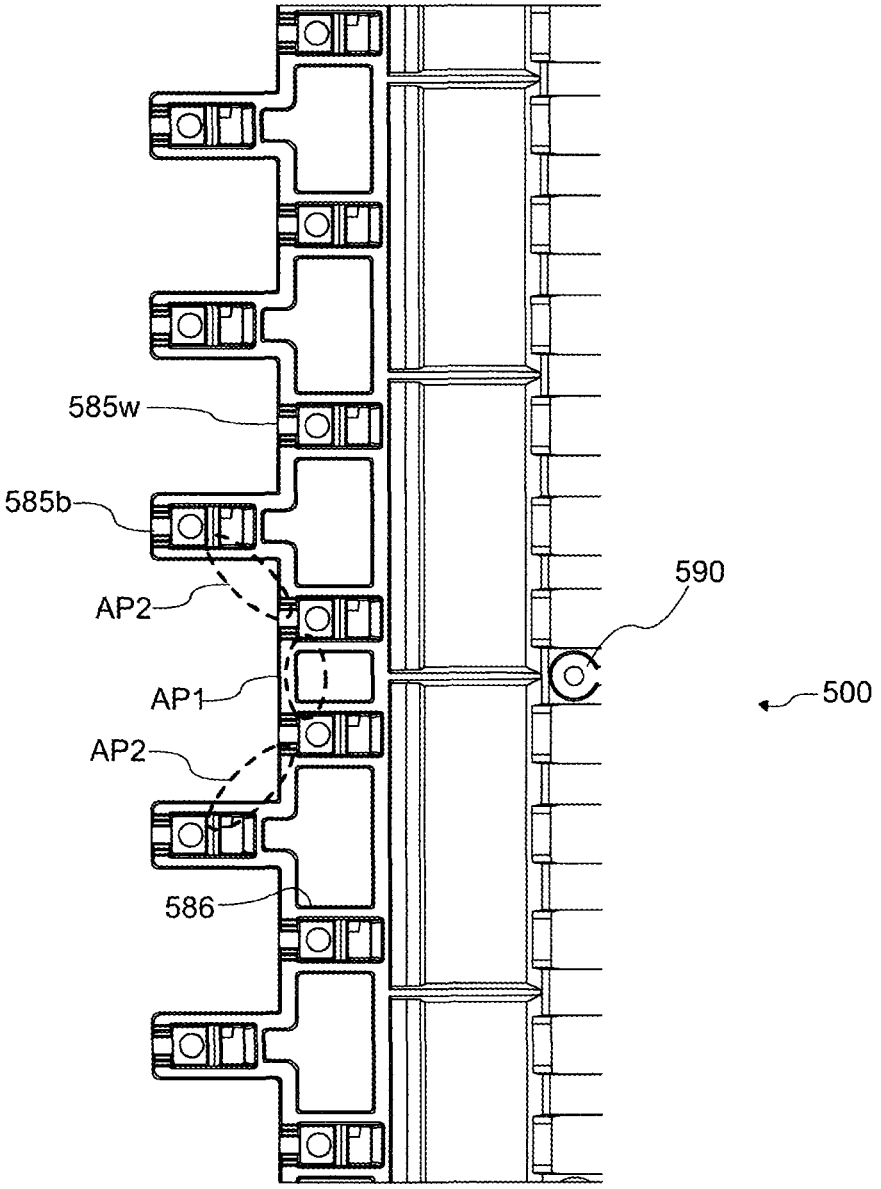
FIG. 6 is an explanatory view of when a portion of the frame where a rod-like flexible member is connected according to the first embodiment is seen from the upper surface.

FIG. 4 is an explanatory view of when the keyboard assembly according to the first embodiment is seen from the upper surface. FIG. 5 is an explanatory view of when the frame according to the first embodiment is seen from the far side (AR5 direction indicated in FIG. 4). FIG. 6 is an explanatory view of when a portion of the frame where the rod-like flexible member is connected according to the first embodiment is seen from the upper surface. In these figures, the illustration of one part of the configurations of the hammer assembly 200 and the frame 500 located on the lower side of the key 100 is omitted. Specifically, the configuration (frame side supporting portion 585, etc.) of the frame 500 in the vicinity of the connecting portion 180 is illustrated, and the illustration of one part of the configuration on the near side, and the like is omitted. In other descriptions as well, the illustration of one part is sometimes omitted.

As shown in FIG. 4, a key side supporting portion 183*b* is arranged on the far side from a key side supporting portion 183*w*. This position is associated with the position of the rod-like flexible member 185 that becomes the turning center of the key 100. The difference in the turning center of the white key and the black key of an acoustic piano can be demonstrated by such arrangement. In this example, a plate-like flexible member 181*b* corresponding to the black key is longer than a plate-like flexible member 181*w* corresponding to the white key. In correspondence with such arrangement, a frame side supporting portion 585*b* of the frame 500 is arranged on the far side from a frame side supporting portion 585*w*. Thus, the shape of the far side (frame side supporting portion 585) of the frame 500 is a shape in which the frame side supporting portion 585*b* is projected out from the frame side supporting portion 585*w*, as shown in FIG. 6.

As shown in FIG. 5, a large space exists between the rod-like flexible members 185*b*, 185*w*. The sound output from the speaker 80 is passed through such space from outside of the keyboard assembly 10 to reach the inside, and released to the outside of the keyboard apparatus 1 from the gap between the adjacent keys 100. As there is only a few elements that shield the passing of the sound between the frame 500 (frame side supporting portion 585) and the connecting portion 180 (key side supporting portion 183) due to the existence of the rod-like flexible member 185 in path until the sound is released to the outside from the appearing portion PV, the attenuation amount of the sound can be suppressed. That is, acoustic passages AP1 and AP2 are arranged between the rod-like flexible members 185 adjacent to each other. Further, as shown in FIG. 6, since the frame side supporting portion 585*b* has a shape protruding beyond the frame side supporting portion 585*w*, the acoustic passage AP2 at a portion to which the frame side supporting portions 585*w* and the 585*b* are adjacent is wider than the acoustic passage AP1 at a portion to which the frame side supporting portion 585*w* is adjacent. Further, as shown in FIG. 6, an opening portion 586 may be arranged in the scale direction of the frame side supporting portion 585*w* on a near side of the frame side supporting portion 585*b*. In this case, the opening portion 586 can also form an acoustic passage.

A supporting column 590 is a member connected to the housing 90 to fix the position of the frame 500 with respect to the housing 90. The supporting column 590 is arranged between portions where the white keys 100*w* are adjacent in the non-appearing portion NV, that is, between the white key 100*w* of "E" and the white key 100*w* of "F", and between the white key 100*w* of "B" and the white key 100*w* of "C".

[Structure of White Key]

FIGS. 7A to 7D are views describing a detailed structure of a white key in the first embodiment. FIG. 7A is a view of the white key 100*w* seen from the upper surface. FIG. 7B is a view of the white key 100*w* seen from the side surface (left side). FIG. 7C is a view of the connecting portion 180 seen from the far side. FIG. 7D is a view of the white key 100*w* seen from the near side.

First, directions (scale direction S, rolling direction R, yawing direction Y, vertical direction V) used in the following description will be defined. The scale direction S corresponds to a direction (left and right direction seen from the player) in which the keys 100 are arrayed, as described above. The rolling direction R corresponds to a direction of rotating with an extending direction (direction from near side to far side seen from the player) of the key 100 as an axis. The yawing direction Y is a direction of bending in the left and right direction when the key 100 is seen from above. There is no great difference between the scale direction S and the yawing direction Y, but the movement in the scale direction S of the key 100 is a parallel movement whereas the movement in the yawing direction Y of the key 100 corresponds to bending (warping) in the scale direction S. The vertical direction V corresponds to a direction (vertical direction seen from the player) in which the rod-like flexible member 185 is extended, and can also be referred to as a direction that becomes an axis of bending in the yawing direction Y.

The key 100 includes the front end key guide 151 and the side key guide 153. As described above, the front end key guide 151 is brought into contact with the front end frame guide 511 of the frame 500 at the upper part and the lower part. Thus, the front end key guide 151 is actually divided into the upper key guide 151*u* and the lower key guide 151*d*. The front end key guide 151 (upper key guide 151*u*, lower key guide 151*d*) and the side key guide 153 regulate the movement of the key 100 at three locations not lined in a straight line when the key 100 is seen in the scale direction S. The movement of the key 100 is regulated in the scale direction S, the yawing direction Y, and the rolling direction R according to the guide at least three locations arranged in such manner. In this example, the side key guide 153 also regulates the movement in the front and back direction of the key 100 as the side frame guide slidably moves on a groove 1535 formed by projections 1531, 1533. The number of guides may be three or more locations. In this case, not all guides need to satisfy a requirement of not being lined in a straight line, and the guide at at least three locations merely needs to satisfy the requirement.

The plate-like flexible member 181 is a plate-like member having flexibility. The plate-like flexible member 181 is arranged so that a normal direction N of a plate surface is directed in the scale direction S. Thus, the plate-like flexible member 181 can be deformed in the rolling direction R and the yawing direction Y by being bent and twisted. In other words, the plate-like flexible member 181 has a degree of freedom in the rolling direction R and the yawing direction Y of the key 100 due to its flexibility. It can be said that the plate-like flexible member 181 also has a degree of freedom in the scale direction S by combining the deformation in the yawing direction Y. However, the plate-like flexible member 181 barely deforms in the vertical direction. The normal direction N may not completely coincide with the scale direction S. and merely needs to have a component in the scale direction S. If the normal direction does not coincide with the scale direction, an angle formed by the normal direction N and the scale direction S is preferably as small as possible.

The rod-like flexible member 185 is a rod-like member having flexibility. The rod-like flexible member 185 can be deformed in the rolling direction R and the yawing direction Y by being bent and twisted. In other words, the rod-like flexible member 185 has a degree of freedom in the rolling direction R and the yawing direction Y of the key 100 due to its flexibility. It can be said that the rod-like flexible member 185 also has a degree of freedom in the scale direction S by combining the deformation in the rolling direction R. However, the rod-like flexible member 185 barely deforms in the vertical direction. The rod-like flexible member 185 has more twistable amount than the plate-like flexible member 181 due its shape property.

A cross-sectional shape (cross-section perpendicular to rod-like extending direction (corresponds to longitudinal direction in a case of a rod shape lying along a straight line)) of the rod-like flexible member 185 is a shape surrounded by a combination of a curved line and a straight line, and is a semicircular shape in the present example. In a semicircular shape, a straight line portion is on the far side and a curved portion is on the near side, but may be reversed. The cross-sectional shape of the rod-like flexible member 185 may be a shape (e.g., circular shape) surrounded by only curved lines, or may be a shape (e.g., rectangular shape) surrounded by only straight lines. In other words, as long as the rod-like flexible member 185 can be bent deformed in directions (two out of three directions defining three-dimension) other than the longitudinal direction (vertical direction), and can be twist deformed with the longitudinal direction as an axis, the cross-sectional shape may be any shape. The rod-like flexible member 185 may have a shape in which a thickness changes along the longitudinal direction such as a cone shape. Furthermore, when an outer edge of the cross-sectional shape of the rod-like flexible member 185 is accommodated in a rectangle, a ratio of a length of two orthogonal sides of the rectangle is desirably greater than or equal to ¾ and smaller than or equal to 4/3.

Thus, the connecting portion 180 not only turns the key 100 in a pitch direction (turning direction of normal pushing of key) with respect to the frame 500 so that a vertical displacement barely occurs (vertical movement of turning center barely occurs) with respect to a strong force of pushing of the key at a back side of the key (far side) from the side key guide 153, but also allows deformation with respect to the rolling direction R and the yawing direction Y. In other words, the connecting portion 180 not only turns the key 100 with respect to the frame 500, but allows deformation with respect to the rolling direction R and the yawing direction Y. The connecting portion 180 has the movement regulated in the vertical direction, but has a degree of freedom with respect to the rolling direction R and the yawing direction Y of the key 100. As described above, it can be said that the connecting portion 180 also has a degree of freedom in the scale direction S by combining the deformation in the rolling direction R.

As described above, the key 100 sometimes produces deformation including the yawing direction Y and rolling direction R due to manufacturing error and temporal change. In this case, the influence of deformation of the key 100 is prevented from being visibly recognized as much as possible in the appearing portion PV between the front end key guide 151 and the side key guide 153 by the regulation of such guides. As the influence of deformation is suppressed at the appearing portion PV, the non-appearing portion NV is greatly subjected to such influence of deformation. The influence is more significant the longer the key 100.

For example, assume a case in which a deformation (deformation in the rolling direction R) where the key 100 is gradually twisted occurred as a first example. In this case, the direction of the rolling direction R of the front end portion of the key 100 is regulated so as to be in a perpendicular direction by the upper key guide 151*u* and the lower key guide 151*d*, and thus the influence of deformation in the rolling direction R becomes greater toward the far side in the key 100. As a second example, assume a case in which a deformation (deformation in the yawing direction Y) where the key 100 is gradually bent in the scale direction S occurred. In this case, the position in the scale direction S of the key 100 in the appearing portion PV is regulated by the front end key guide 151 and the side key guide 153, and thus the influence of deformation in the yawing direction Y becomes greater toward the far side in the key 100.

In either case, the positions of the portion that becomes the turning center of the key 100 and the frame 500 start to shift by the influence of deformation of the key 100. In other words, the position relationship of the connecting portion 180 connected to the key 100 and the frame side supporting portion 585 starts to shift.

According to the key 100 of the first embodiment, the plate-like flexible member 181 and the rod-like flexible member 185 can be deformed by flexibility, and the influence of the shift in the positions of the key 100 and the frame side supporting portion 585 can be suppressed by the deformation of the connecting portion 180 (plate-like flexible member 181 and rod-like flexible member 185). At this time, the rod-like flexible member 185 not only has a function of a member for turning the key 100 in the pitch direction as it can be bent deformed in the front and back direction of the key 100 while preventing vertical displacement from barely occurring (vertical movement of the turning center from barely occurring) with respect to a strong force of pushing of the key, but also has a function of a member for absorbing the influence of deformation of the key 100.

As described above, the influence of deformation of the key 100 is suppressed as much as possible from being visibly recognized at the appearing portion PV, and thus the positional precision in the scale direction S is also high. Thus, the front end 210 of the hammer assembly 200 detected by the sensor 300 and the hammer supporting portion 120 of the key 100 connected to the front end 210 are desirably arranged on the lower side of the key 100 of the appearing portion PV (front side from the back end of the key main body portion).

[Structure of Rod-Like Flexible Member]

In this example, the rod-like flexible member 185 is detachable from the key side supporting portion 183 and the frame side supporting portion 585. The configuration of the rod-like flexible member 185 will be described. The rod-like flexible member 185 may not be detachable from at least one of the key side supporting portion 183 and the frame side supporting portion 585.

Figure 8A:
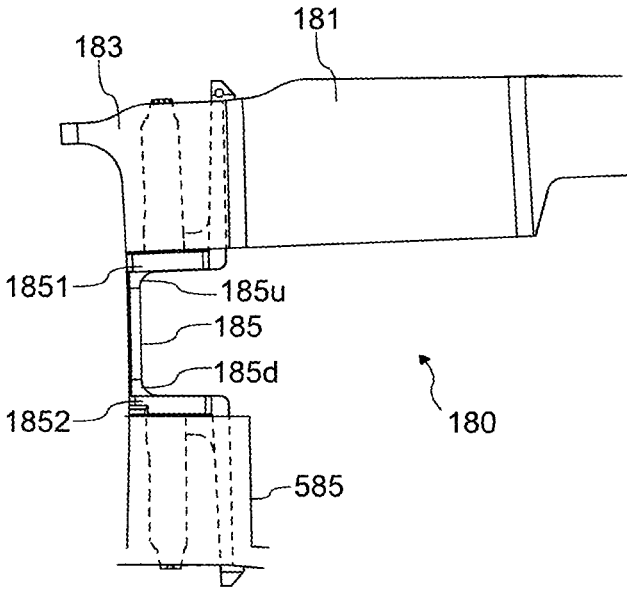
FIG. 8A is a view describing a structure of the rod-like flexible member according to the first embodiment and an enlarged view showing a neighborhood of a connecting portion in FIG. 7B.
Figure 8B:
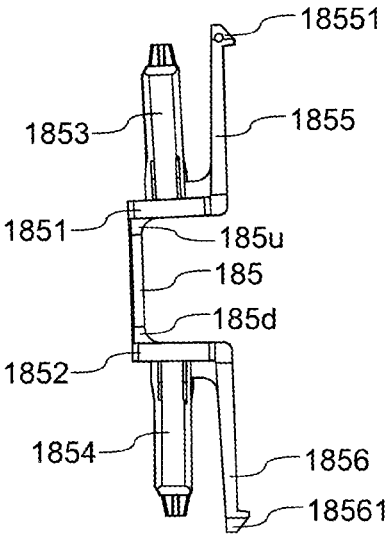
FIG. 8B is a view describing the structure of the rod-like flexible member according to the first embodiment and a view showing a state where the rod-like flexible member has been removed.
Figure 8C:
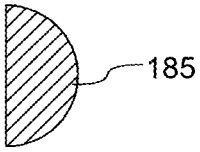
FIG. 8C is a view describing the structure of the rod-like flexible member according to the first embodiment and a view describing a cross-sectional shape of the rod-like flexible member.

FIGS. 8A to 8C are views describing the structure of the rod-like flexible member according to the first embodiment. FIG. 8A is an enlarged view of a neighborhood of the connecting portion 180 in FIG. 7B. FIG. 8B is a view showing a state where the rod-like flexible member 185 has been removed. FIG. 8C is a view describing a cross-sectional shape of the rod-like flexible member 185.

The rod-like flexible member 185 is connected to pedestals 1851 and 1852 at both ends thereof. The rod-like flexible member 185 includes regions 185*u* and 185*d* where a thickness of a rod is increased according to coming close to the pedestals at portions connected to the pedestals 1851 and 1852. The regions 185*u* and 185*d* may not exist.

The pedestal 1851 is a plate-like member spreading along a bottom surface of the key side supporting portion 183. The pedestal 1851 is provided with a supporting rod 1853 and an engaging rod 1855 on a face opposite to a face on which the rod-like flexible member 185 is arranged. The supporting rod 1853 is inserted into a hole formed in the key side supporting portion 183 from below. The engaging rod 1855 has a top portion on which an engaging portion 18551 is arranged. The engaging rod 1855 is inserted into a hole formed in the key side supporting portion 183 from below. The engaging portion 18551 is caught on an upper surface of the key side supporting portion 183, so that the engaging rod 1855 is prevented from coming out of the key side supporting portion 183 due to turning of the key 100. The engaging rod 1855 has flexibility. Engagement to the key side supporting portion 183 performed by the engaging rod 1855 is released by deforming the engaging rod 1855 toward the supporting rod 1853.

The pedestal 1852 is a plate-like member spreading along an upper surface of the frame side supporting portion 585. The pedestal 1852 is provided with a supporting rod 1854 and an engaging rod 1856 on a face opposite to a face where the rod-like supporting member 185 is arranged. The supporting rod 1854 is inserted into a hole formed in the frame side supporting portion 585 from above. The engaging rod 1856 has a top portion where an engaging portion 18561 is arranged. The engaging rod 1856 is inserted into a hole formed in the frame side supporting portion 585 from above. The engaging portion 18561 is caught on a lower surface of the frame side supporting portion 585, so that the engaging rod 1856 is prevented from coming out of the frame side supporting rod 585 due to turning of the key 100. The engaging rod 1856 has flexibility. Engagement to the frame side supporting portion 585 performed by the engaging rod 1856 is released by deforming the engaging rod 1856 toward the supporting rod 1854.

In this manner, the rod-like flexible member 185 is supported by the key side supporting member 183 and the frame side supporting member 585, so that when the key 100 is at a rest position (when the rod-like flexible member 185 is not deformed), a longitudinal direction (vertical direction V) of the rod-like flexible member 185 is perpendicular (may be approximately perpendicular) to a surface of the key 100 (key main body). Thereby, the rod-like flexible member 185 is strengthened regarding a load to the vertical direction V. Further, at this time, the longitudinal direction (vertical direction V) of the rod-like flexible member 185 may be perpendicular (may be approximately perpendicular) to a normal direction N of the plate-like flexible member 181. An extending direction of the rod-like flexible member 185 may include a portion ranging from 30° or more to 90° or less to the longitudinal direction of the key 100.

FIG. 8C is a view describing a cross-sectional shape of the rod-like flexible member 185. Specifically. FIG. 8C is a view of when the rod-like flexible member 185 has been cut to the longitudinal direction (vertical direction V) of the rod-like flexible member 185 by a vertical face. The cross-sectional shape of the rod-like flexible member 185 has a shape surrounded by a combination of straight lines and curved lines, and in this example, is semicircular. In the semicircular shape, a straight line portion is positioned on a far side, and a curved line portion is positioned on a near side, but these line portions may be reverse. The cross-sectional shape of the rod-like flexible member 185 may has a shape surrounded by only curved lines (e.g., a circular shape) or a shape surrounded by only straight lines (a rectangular shape). That is, as long as the rod-like flexible member 185 can be bent deformed in directions (two directions of three directions defining three dimensions) other than the vertical direction V, and twisting deformation with the vertical direction V as an axis is possible, the cross-sectional shape may have any shape.

[Comparison of White Key and Black Key]

Figure 9A:
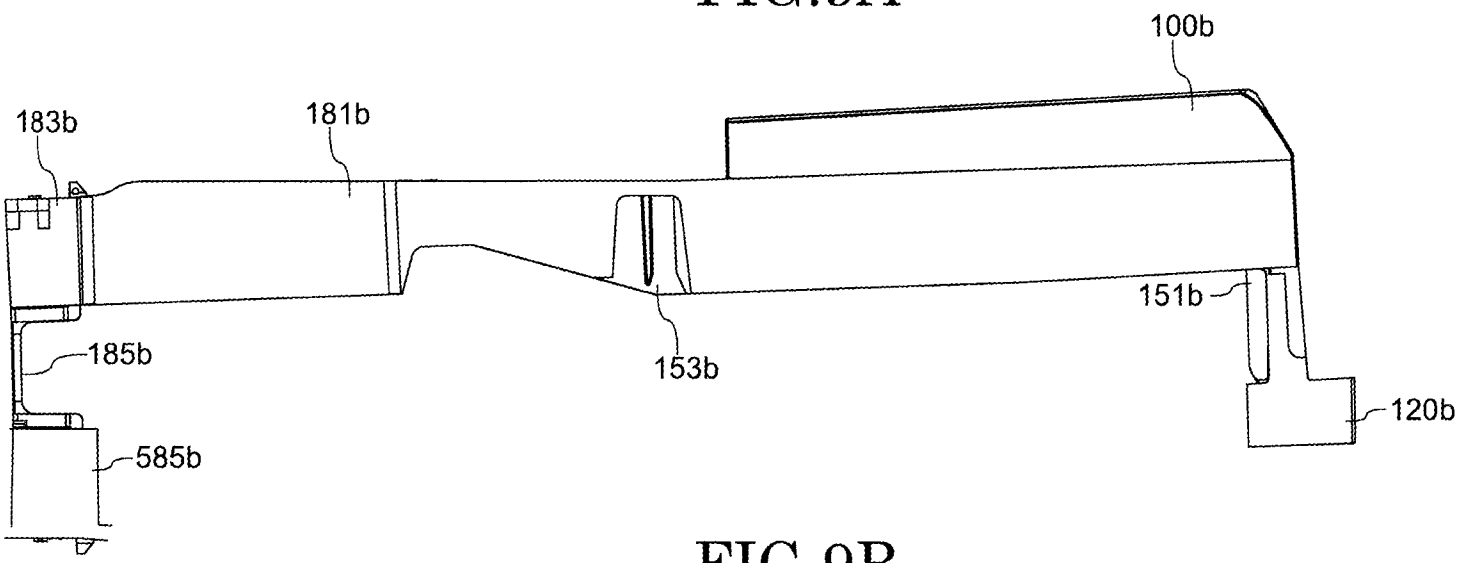
FIG. 9A is a view describing a structure of a black key according to the first embodiment in comparison with the structure of the white key and a view showing the black key.
Figure 9B:
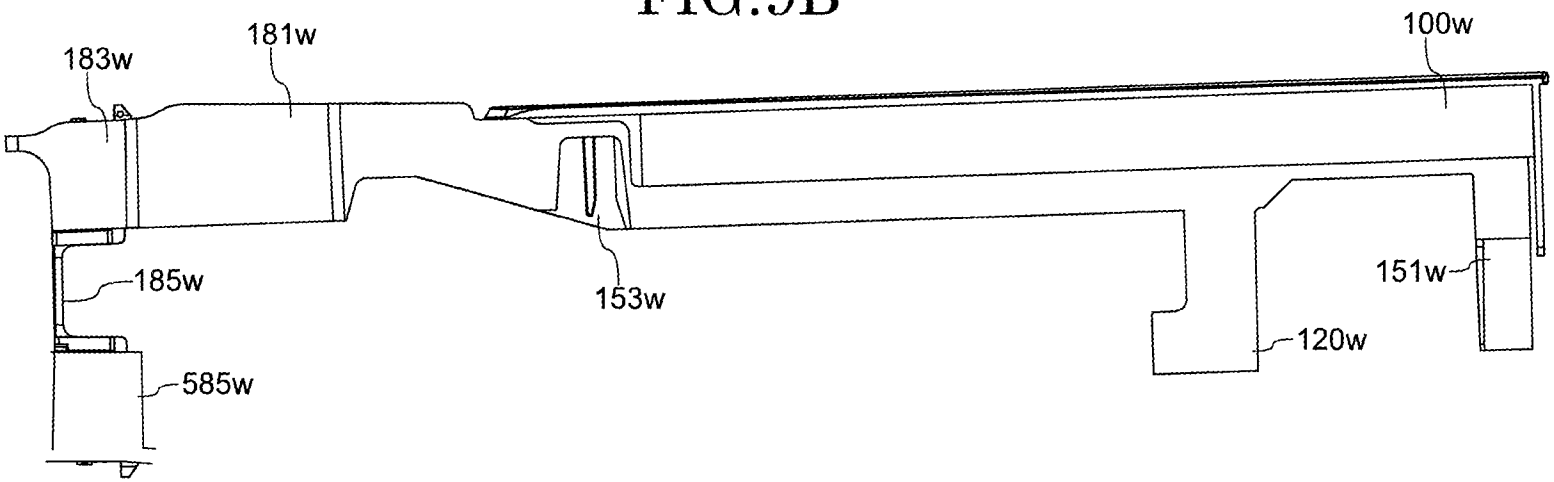
FIG. 9B is a view describing the structure of the black key according to the first embodiment in comparison with the structure of the white key and a view showing the white key.

FIGS. 9A and 9B are views describing a structure of a black key in the first embodiment in comparison with the structure of the white key. FIG. 9A shows a black key. FIG. 9B shows a white key. In FIGS. 9A and 9B, the positions in the front and back direction of the white key 100*w* and the black key 100*b* are shown in an associated manner. The white key 100*w* and the black key 100*b* differ in the following points. The plate-like flexible member 181*b* is longer than the plate-like flexible member 181*w*. In this example, the positions of the turning center of the key are differed by such difference, but the positions of the turning center of the key may be differed through other methods. For example, the plate-like flexible member 181*b* and the plate-like flexible member 181*w* may have the same length, and the length other than the plate-like flexible member 181*b* of the black key 100*b* may be lengthened.

In the white key 100*w*, the front end key guide 151*w* is arranged at a different location with respect to the key front and back direction from the hammer supporting portion 120*w*. In the black key 100*b*, on the other hand, the front end key guide 151*b* and the hammer supporting portion 120*b* are arranged at substantially the same location in the key front and back direction. In other words, in the black key 100*b*, the hammer supporting portion 120*b* is arranged at a front end portion of the black key 100*b*. That is, the hammer supporting portion 120*w* of the white key 100*w* is arranged in accordance with the position of the hammer supporting portion 120*b* of the black key 100*b*.

[Operation of Keyboard Assembly]

Figure 10A:
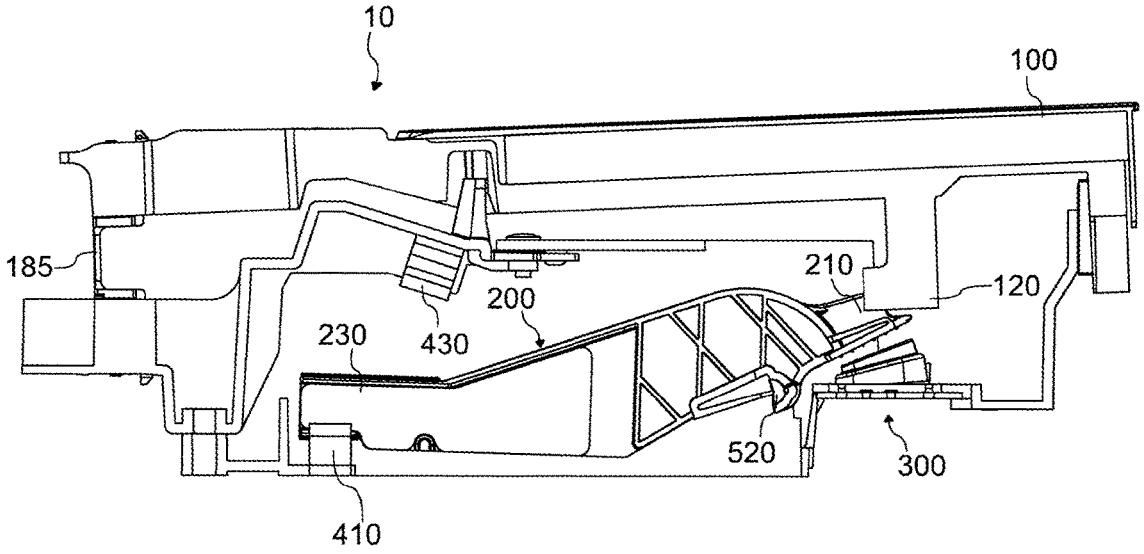
FIG. 10A is a view describing an operation of a key assembly of when the key (white key) according to the first embodiment is pushed and a view of a case where the key is at a rest position (a state where the key is not pushed).
Figure 10B:
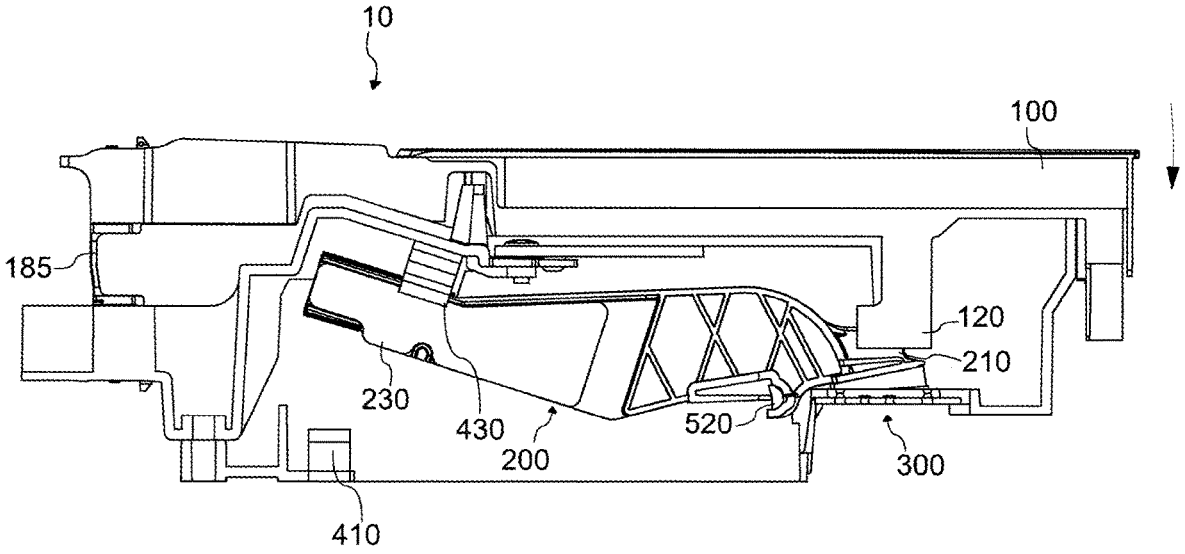
FIG. 10B is a view describing the operation of the key assembly of when the key (white key) according to the first embodiment is pushed and a view of a case where the key is at an end position (a state where the key is pushed up to the end).

FIGS. 10A and 10B are views describing an operation of the key assembly of when the key (white key) is pushed in the first embodiment. FIG. 10A is a view of when the key 100 is at a rest position (a state where the key is not pushed). FIG. 10B is a view of when the key 100 is at an end position (a state where the key is pushed to the end). When the key 100 is pushed, the key is bent with the rod-like flexible member 185 as the turning center. In this case, the rod-like flexible member 185 is bent deformed toward the front side (near side direction) of the key, but the key 100 is turned in the pitch direction rather than being moved forward by the regulation of the movement in the front and back direction by the side key guide 153. As the hammer supporting portion 120 pushes down the front end 210, the hammer assembly 200 turns with the shaft 520 as the center. The turning of the hammer assembly 200 stops when the weight portion 230 hits the upper stopper 430, whereby the key 100 reaches the end position. Furthermore, when the sensor 300 is deformed by the front end 210, the sensor 300 outputs a detection signal at a plurality of stages corresponding to the deformed amount (key pushing amount).

When the key is released, the weight portion 230 is moved toward the lower side, the hammer assembly 200 is turned, and the key 100 is turned toward the upper side. The turning of the hammer assembly 200 is stopped when the weight portion 230 is brought into contact with the lower stopper 410, and the key 100 is returned to the rest position.

The keyboard apparatus 1 of the first embodiment has the key 100 connected to be turnable by the pushing of the key and the releasing of the key at the connecting portion 180, as described above. The keyboard apparatus 1 can reduce the influence of deformation caused by the manufacturing error and the temporal change of the key 100 on the appearing portion PV by the regulation of the movement by the front end key guide 151 and the side key guide 153 and the deformation of the connecting portion 180.

Further, by using the rod-like flexible member 185, movement or deformation in various directions can be allowed in one member (the same region). Therefore, as compared with the conventional art where a region must be sectioned for each direction allowing movement or deformation and a plurality of members must be combined, the influence on the size of the keyboard apparatus 1 is suppressed by using a rod-like member having flexibility in the keyboard apparatus 1 in the first embodiment.

Second Embodiment

In a second embodiment, a keyboard assembly 10A provided with a connecting portion 180A having a configuration different from that of the connecting portion 180 in the first embodiment will be described.

Figure 11A:
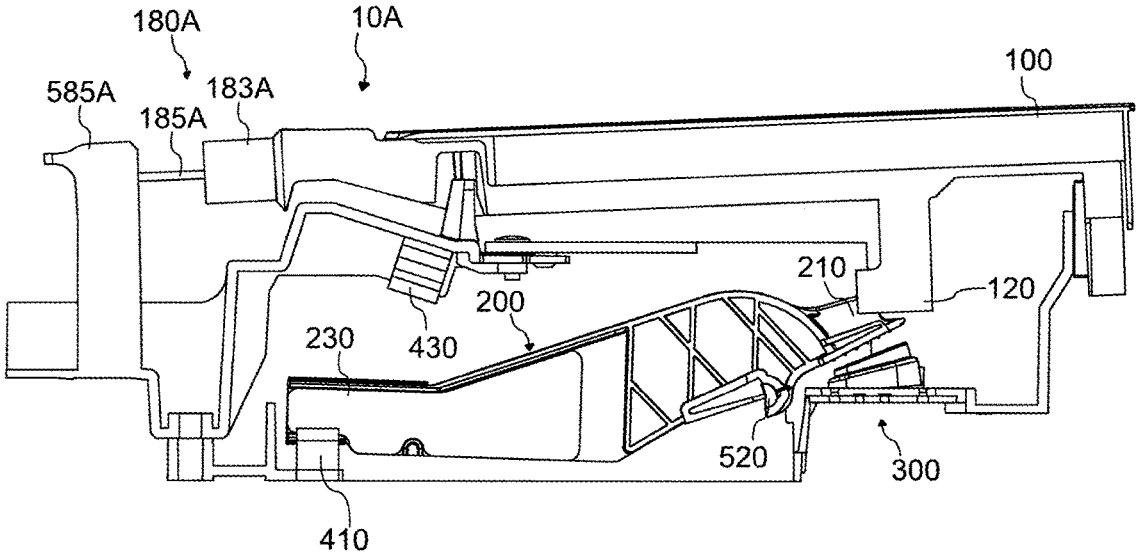
FIG. 11A is a view describing a structure of a keyboard assembly according to a second embodiment and a view of a case where a key is at the rest position (a state where the key is not pushed).
Figure 11B:
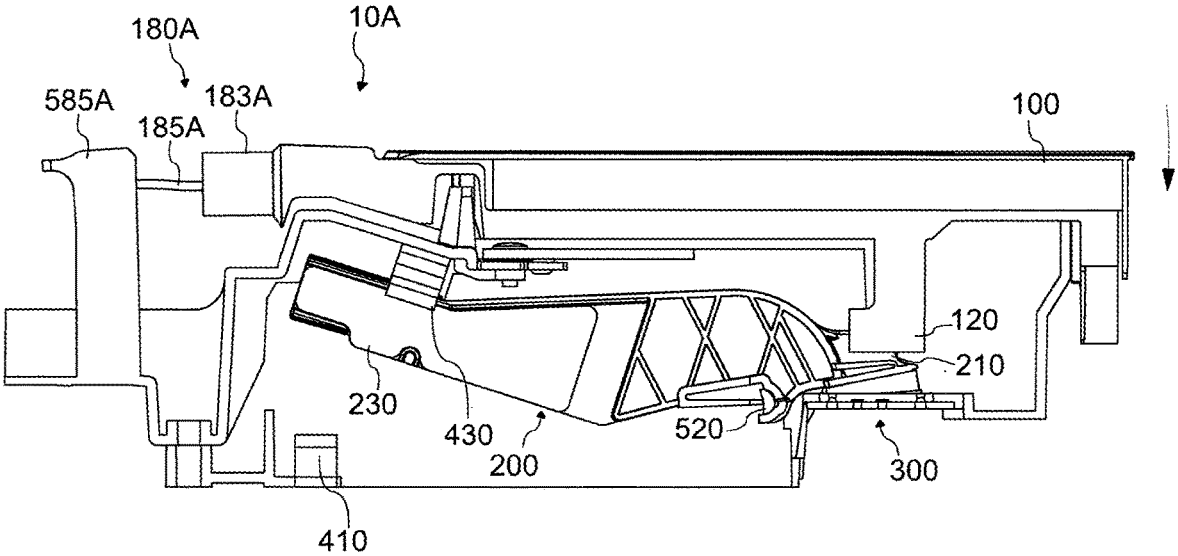
FIG. 11B is a view describing the structure of the key assembly according to the second embodiment and a view of a case where the key is at the end position (a state where the key is pushed up to the end).

FIGS. 11A and 11B are views describing a structure of a keyboard assembly in the second embodiment. FIG. 11A is a view of when a key 100 is at a rest position (a state where the key is not pushed). FIG. 11B is a view of when the key 100 is at an end position (a state where the key is pushed up to the end). The connecting portion 180A is provided with a key side supporting portion 183A and a rod-like flexible member 185A. The rod-like flexible member 185A is supported by the key side supporting portion 183A and a flame side supporting portion 585A. The frame side supporting portion 585A is protruded up to a far side of a rear end of the key 100. The rod-like flexible member 185A is arranged to be capable of bending deforming in a vertical direction of the key 100. In this example, a longitudinal direction of the rod-like flexible member 185A is arranged to be parallel (be approximately parallel) to the front and back direction of the key 100. An extending direction of the rod-like flexible member 185A may include a portion ranging from 0° or more to 30° or less to the longitudinal direction of the key 100.

When the key 100 is pushed, downward bending deformation of the key 100 occurs in the rod-like flexible member 185A, and the key 100 is turned with the rod-like flexible member 185A as the turning center. Since the other configurations are similar to those of the first embodiment, explanation thereof is omitted.

In the second embodiment, a turning center of a black key 100*b* is arranged at a far side farther than a turning center of a white key 100*w* like the first embodiment. Even in this case, it is desirable that a rod-like flexible member 185*w*A (corresponding to the rod-like flexible member 185A in FIGS. 11A and 11B) turning the white key 100*w* has the same length as the rod-like flexible member 185*b*A turning the black key 100*b*. That is, it is desirable that the rod-like flexible member 185*b*A is arranged at a far side farther than the rod-like flexible member 185*w*A.

Alternative Embodiment (1) The rod-like flexible member 185 according to the first embodiment as described above is semi-cylindrical and has a fixed thickness except for the regions 185*u* and the region 185*d* at both the end thereof, but the thickness may change. In this case, it is desirable that a central portion of the rod-like flexible member 185 is thinner than both the end sides (both the end portions) of the rod-like flexible member 185.

Figure 12A:
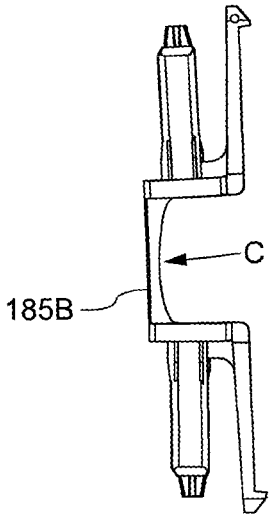
FIG. 12A is a view describing a structure of a rod-like flexible member according to an alternative embodiment and a view showing the rod-like flexible member whose cross-section is semicircular and whose size varies over all.
Figure 12B:
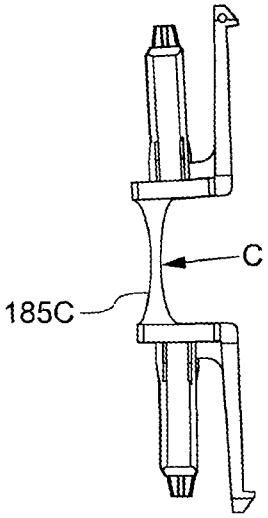
FIG. 12B is a view describing a structure of the rod-like flexible member according to the alternative embodiment and a view showing the rod-like flexible member whose cross-section is circular and whose size changes over all.

FIGS. 12A and 12B are views describing a structure of a rod-like flexible member in an alternative embodiment. FIG. 12A shows a rod-like flexible member 185B whose cross-section is semicircular like the rod-like flexible member 185 in the first embodiment and whose thickness changes over all. FIG. 12B shows a rod-like flexible member 185C whose cross-sectional shape is circular and whose thickness changes over all. Both of the rod-like flexible members 185B and 185C become the thinnest at central portions C in their longitudinal directions. Even in such a shape, the rod-like flexible members 185B and 185C can be bent deformed in a direction except for the vertical direction V, and can be twisted deformed with the vertical direction V as an axis. Further, improvement of the strength is possible and control can be performed such that the region where the bending deformation occurs is positioned at a central portion.

(2) The turning center of the black key 100*b* and the turning center of the white key 100*w* may be the same position with respect to the far side direction. In this case, the size of the connecting portions 180*b*, 180*w* in the scale direction S is to be defined so that the connecting portions 180*b*, 180*w* can be arranged adjacent to each other.

(3) In the connecting portion 180 described above, two kinds of flexible members composed of the plate-like flexible member 181 and the rod-like flexible member 185 are included, but the plate-like flexible member 181 may not exist.

(4) The key 100 is a structural body made of resin, but the visual impression thereof may be improved by attaching a wood member on a side surface at a portion (key main body portion) of the appearing portion PV of the key 100. In this case, the side key guide 153 is preferably arranged in a region other than the region where the wood member is attached, that is, the region where the resin member is exposed. In other words, the side frame guide 513 makes contact with the region of the resin member.

(5) The regulation of the movement in the front and back direction of the key 100 has been realized by the side key guide 153, but may be realized by other guides.

REFERENCE SIGNS LIST

1 . . . keyboard apparatus
10, 10A . . . keyboard assembly
70 . . . sound source device
80 . . . speaker
90 . . . housing
100 . . . key
100*w* . . . white key
100*b* . . . black key
120, 120*w*, 120*b* . . . hammer supporting portion
151, 151*w*, 151*b* . . . front end key guide
151*u* . . . upper key guide
151*d* . . . lower key guide
153, 153*w*, 153*b* . . . side key guide
1531, 1533 . . . protrusion
1535 . . . groove
180, 180A . . . connecting portion
181, 181*w*, 181*b* . . . plate-like flexible member
183, 183*w*, 183*b*, 183A . . . key side supporting portion
185, 185*w*, 185*b*, 185A, 185B, 185C . . . rod-like flexible member
1851, 1852 . . . pedestal
1853, 1854 . . . supporting rod
1855, 1856 . . . engaging rod
18551, 18561 . . . engaging portion
200 . . . hammer assembly
210 . . . front end
220 . . . shaft supporting portion
230 . . . weight portion
300 . . . sensor
410 . . . lower stopper
430 . . . upper stopper
500 . . . frame
511 . . . front end frame guide
513 . . . side frame guide
520 . . . shaft
585, 585*w*, 585*b*, 585A . . . frame side supporting portion
586 . . . opening portion
590 . . . supporting column
710 . . . signal converting unit
730 . . . sound source unit
750 . . . output unit

What is claimed is:

1. A keyboard apparatus comprising:
a key; and
a connecting member connecting the key to a frame and including a rod-like flexible member arranged between the frame and the key, the key being turned to the frame by bending of the rod-like flexible member,
wherein a central portion of the rod-like flexible member is thinner than both end portions of the rod-like flexible member to permit the central portion to flex while restricting the end portions from flexing.

2. The keyboard apparatus according to claim 1, wherein the rod-like flexible member bends in a front and back direction of the key.

3. The keyboard apparatus according to claim 2, further comprising a guide regulating movement of the key in the front and back direction.

4. The keyboard apparatus according to claim 1, wherein when the key is at a rest position, an extending direction of the rod-like flexible member includes a portion ranging from 30° or more to 90° or less to a longitudinal direction of the key.

5. The keyboard apparatus according to claim 1, wherein the rod-like flexible member bends in a vertical direction of the key.

6. The keyboard apparatus according to claim 1, wherein when the key is at a rest position, an extending direction of the rod-like flexible member includes a portion ranging from 0° or more to 30° or less to a longitudinal direction of the key.

7. The keyboard apparatus according to claim 1, further comprising:
a sensor configured to detect an operation to the key; and
a sound source unit configured to generate a sound waveform signal according to an output signal of the sensor.

8. The keyboard apparatus according to claim 7, further comprising:
a speaker arranged in a housing of the keyboard apparatus on a side opposite to the key and configured to output the generated sound waveform signal to an external space.

9. A keyboard apparatus comprising:
a key; and a connecting member connecting the key to a frame and including a rod-like flexible member arranged between the frame and the key, the key being turned to the frame by bending of the rod-like flexible member, wherein the rod-like flexible member has a curved line portion in a cross-section perpendicular to an extending direction.

* * * * *